US007644884B2

(12) United States Patent
Foss et al.

(10) Patent No.: US 7,644,884 B2
(45) **Date of Patent: *Jan. 12, 2010**

(54) TOILET PAPER REWINDING MACHINE

(76) Inventors: Milton Foss, 81 - W. Vancouver Dr., Port Townsend, WA (US) 98368; Ed Stuck, 931 Grants St., Port Townsend, WA (US) 98368; Neil Vanderven, 2494-Cape Geo Rd., Port Townsend, WA (US) 98368

( * ) Notice: Subject to any disclaimer, the term of this patent is extended or adjusted under 35 U.S.C. 154(b) by 80 days.

This patent is subject to a terminal disclaimer.

(21) Appl. No.: 11/893,977

(22) Filed: Aug. 17, 2007

(65) Prior Publication Data

US 2008/0048061 A1 Feb. 28, 2008

Related U.S. Application Data

(63) Continuation-in-part of application No. 11/787,871, filed on Apr. 17, 2007, now abandoned, and a continuation-in-part of application No. 11/510,249, filed on Aug. 24, 2006, now abandoned.

(51) Int. Cl.
*B65H 26/06* (2006.01)

(52) U.S. Cl. ..... 242/534.2; 242/532; 242/538

(58) Field of Classification Search ..... 242/534.2, 242/532, 538, 538.1, 551, 422.4, 532.5, 545.1, 242/586.2, 599.4
See application file for complete search history.

(56) References Cited

U.S. PATENT DOCUMENTS

| | | | | |
|---|---|---|---|---|
| 795,507 | A * | 7/1905 | Hatfield et al. | 242/532.5 |
| 1,894,253 | A * | 1/1933 | McCarthy et al. | 242/532.2 |
| 2,794,606 | A * | 6/1957 | Miller | 242/422.4 |
| 3,175,780 | A * | 3/1965 | Nettles | 242/539 |
| 5,301,883 | A * | 4/1994 | Lukaart | 242/534.2 |
| 5,794,870 | A * | 8/1998 | Langlie | 242/538.2 |
| 6,019,306 | A * | 2/2000 | Cramer | 242/538.1 |
| 7,021,030 | B1 * | 4/2006 | Burns | 242/538 |

* cited by examiner

*Primary Examiner*—William A Rivera
(74) *Attorney, Agent, or Firm*—Dean A. Craine

(57) ABSTRACT

A machine used to rewind toilet paper from partial toilet paper rolls and make a single large toilet paper roll. The machine includes a pivotally mounted unwinding spool and a take-up spool mounted both horizontally over a platform. The take-up spool includes at least one plunger that extends outward from its outer surface to selectively engage the inside paper core commonly used on a roll of toilet paper roll. The take-up spool is coupled to an electric motor that rotates the take-up spool. A spring is disposed between the unwinding spool and the take-up spool to reduce tension of the toilet paper as it is rewound. During use, two partially used toilet paper rolls are placed on the take-up spool and the unwinding spool. The loose ends of paper on the partial rolls are loosely over lapped and wrapped on the take-up spool. The electric motor is then activated to wind the toilet paper from the unwinding spool onto the take-up spool.

8 Claims, 7 Drawing Sheets

TOILET PAPER REWINDING MACHINE

This is a continuation-in-part application based on the utility patent application filed on Aug. 24, 2006 (Ser. No. 11/510,249), and the continuation-in-part application filed on Apr. 17, 2007 (Ser. No. 11/787,871) now abandoned.

BACKGROUND OF THE INVENTION

1. Field of the Invention

The invention disclosed herein pertains to paper roll rewinding machines and more particularly to such machines designed to rewind partial rolls of toilet paper together to make full rolls of toilet paper.

2. Description of the Related Art

Temporary, portable toilet restrooms are commonly used at construction sites for workers. Temporary, portable restrooms are also commonly used at outdoor events used to supplement fixed restrooms located at the facility that houses the event.

The portable restrooms are usually provided by portable restroom rental companies. These companies are also in charge of maintaining and cleaning the portable restroom unit they install on a daily or weekly basis. The maintenance and cleaning duties include pumping out the collected waste, cleaning and sanitizing the inside surfaces of the restroom, and replacing old, partially used rolls of toilet paper with new rolls of toilet paper.

Under typical rental agreements, the rental companies are responsible for maintaining a sufficient quantity of toilet paper in the portable restrooms at all times. If the portable restroom runs out of toilet paper before the next service date, the portable restroom must be temporarily closed until a rental company representative delivers new rolls of toilet paper to the restroom.

Because unscheduled service calls are expensive, portable restroom rental companies typically supply excessive amounts of toilet paper with each restroom. If a partial roll remains in the portable restroom when the restroom is being serviced, it is discarded and replaced with a full roll. The partial rolls are usually returned to the company and later discarded or donated to charities or to the company's employees.

What is needed is a machine designed to allow portable restroom rental companies to easily and quickly rewind partially used rolls of toilet paper

SUMMARY OF THE INVENTION

It is an object of the present invention to provide a toilet paper roll rewinding machine.

It is another object of the present invention to provide such a machine that unwinds toilet paper from a partially used roll onto another partially used roll to produce a full roll of toilet paper.

It is a further object of the present invention to provide such a machine that is safe and easy to operate.

These and other objects of the present invention are met by a toilet paper rewinding machine disclosed herein designed to rewind toilet paper from a partial toilet paper roll onto another partial roll to make a large or full size roll of toilet paper. The machine includes an unwinding spool and a take-up spool mounted in an elevated, horizontal alignment over a lower rigid platform designed to be setup on a flat workbench. In one embodiment, the base of the unwinding spool is pivotally mounted onto the platform. A hinge is mounted on the inside edge of the unwinding spool thereby allowing the unwinding spool to rotate inward and reduce the spacing between the center axis of the unwinding spool and the take-up spool. Also, when unwinding spool rotates inward the angle of the section of the toilet paper that extends between the unwinding spool and the take up spool is automatically adjusted. Also, the weight of the unwinding spool forces the unwinding spool outward so that the toilet paper is sufficiently taunt to form a tight roll of toilet paper. An optional low tension biasing means is disposed between the hinged unwinding spool and the take-up spool which reduces the amount of tension exerted on the toilet paper between the unwinding spool and the take-up spool.

Both spools include a cylindrical spool body with a cylindrical cavity formed therein. Disposed inside each cavity is a longitudinally aligned handle assembly. Each handle assembly includes a cam which is coupled to at least one plunger that moves transversely through the spool body's sidewall.

During operation, each handle assembly is manually rotated or forced inward longitudinally in the spool body which causes the plungers to extend outward from the spool's sidewall and engages a cylindrical paper core commonly found a roll of toilet paper when over the spool body. When each plunger is extended from the spool's sidewall, the roll of toilet paper is temporarily held in a fixed position thereon. When the handle assembly is rotated or pulled in the opposite direction, the plunger retracts into the spool body, thereby allowing the roll of toilet paper to rotate freely and slide off the spool body. The handle assembly includes a relatively small handle that extends from the distal end of the spool body. The handle has a relatively small diameter thereby allowing the roll of toilet paper to be easily placed or removed from the spool body without having to remove the handle from the spool body.

Attached to the proximal end of the take-up spool is a larger diameter, coaxially aligned circular flange designed to keep a toilet paper roll properly aligned on the roll's core when the partial roll of toilet paper is rotated. A large pulley is attached to the distal end of the drive shaft on the take-up spool which engages to a belt coupled to a small pulley connected to the drive shaft on an electric motor mounted on the platform. In the embodiment with the biased, hinged unwinding spool, the unwinding spool and take-up spool are slightly offset so that the biasing means may automatically force the unwinding spool and the take-up spool closer together as the size of the rolls of paper are adjusted during operation.

During use, the two plungers are retracted on the two spools. A first partial toilet paper roll is placed on the take-up spool and a second partial roll of toilet paper is placed on the unwinding spool. The loose ends of the two rolls of toilet paper are then loosely or adhesively connected together. The plungers on both spools are then extended outward to engage the paper cores of the two rolls to securely hold them on the spools. The electric motor is then activated to rotate the take-up spool and rewind the toilet paper from the second partial roll on the unwinding spool. When a full roll is formed, or when the toilet paper on the second roll is unwound, the electric motor is deactivated and the full first roll and the empty core are removed. In the preferred embodiment, a foot pedal switch is provided which selectively controls activation and deactivation of the electric motor.

The rewinding machine is specifically designed to be safe and easy to operate. The rewinding machine uses rotating handles and switch, and does not require parts that must be removed and attached to the machine. It may be used by handicapped individuals, enabling them to be gainfully employed.

DESCRIPTION OF THE PREFERRED EMBODIMENT(S)

Figure 1:
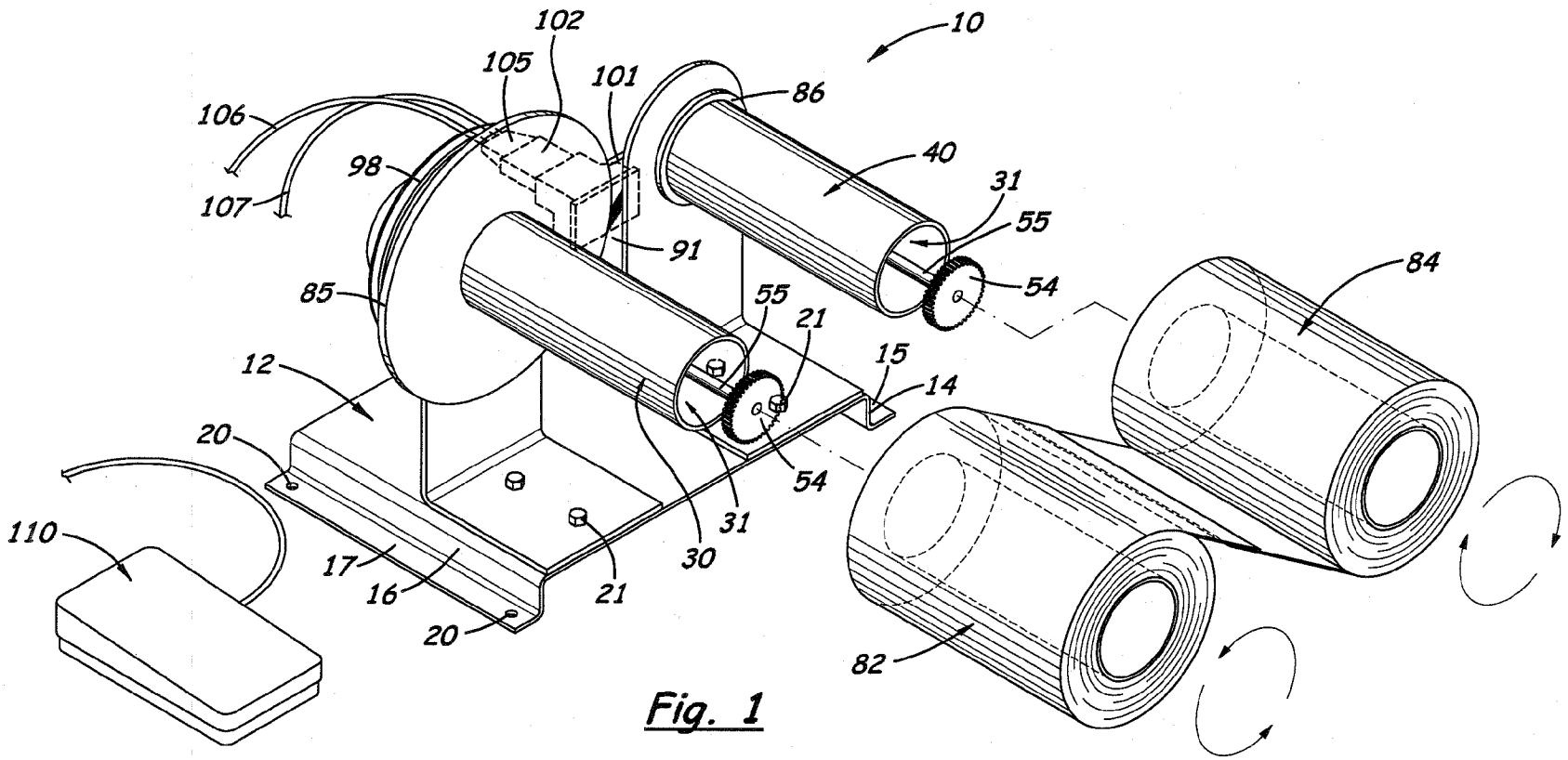
FIG. 1 is a front perspective view of the toilet paper roll rewinding machine disclosed herein with the two partial rolls of toilet paper placed on the take-up and unwinding spools.
Figure 2:
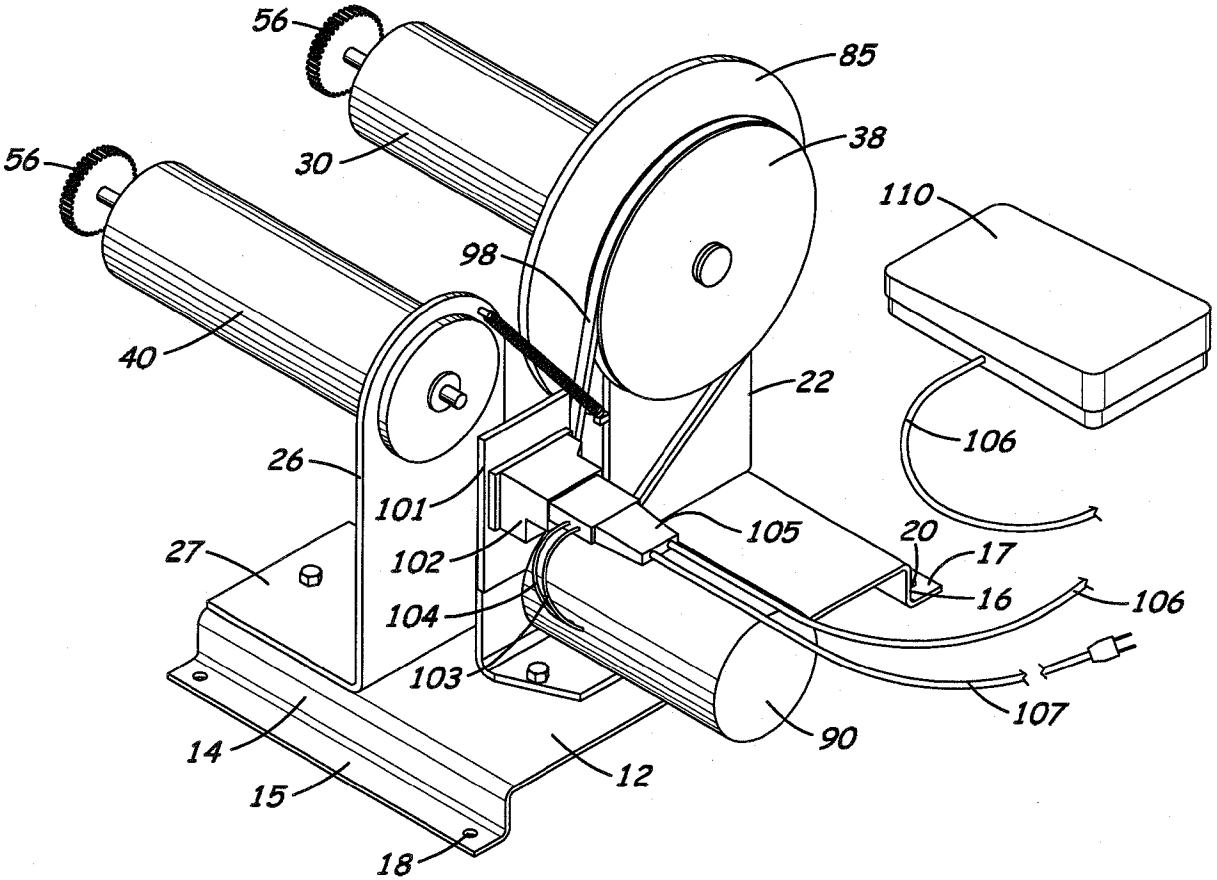
FIG. 2 is a rear perspective view of the toilet paper roll rewinding machine shown in FIG. 1.
Figure 3:
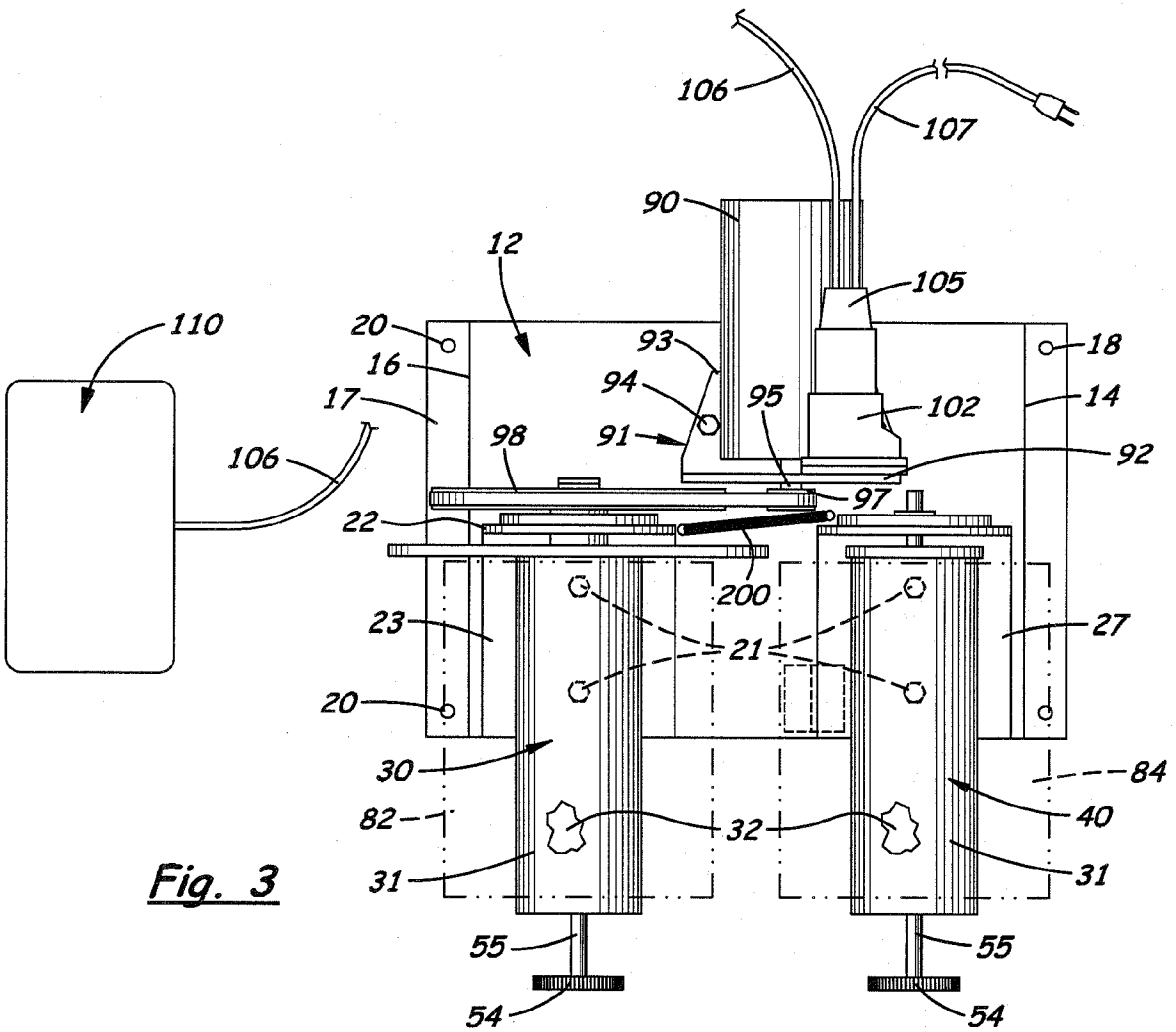
FIG. 3 is a top plan view of the machine.
Figure 4:
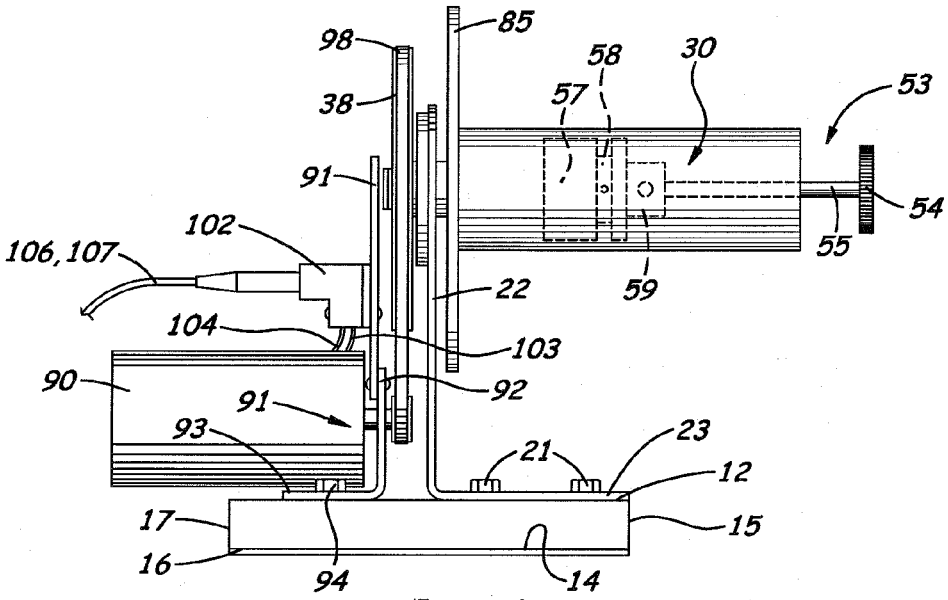
FIG. 4 is a right side elevational view of the machine.

Referring to the accompanying FIGS. 1-11, there is shown a toilet paper rewinding machine 10 disclosed herein designed to rewind toilet paper from a first partial toilet paper roll 82 onto a second partial roll 84 to make a full toilet paper roll 84.

The machine 10 includes a take-up spool 30 and an unwinding spool 40 mounted in an elevated, parallel alignment over a lower platform 12. In the preferred embodiment, the platform 12 is a square or rectangular base made of durable material, such as metal, plastic or wood. In the FIGS. the platform 12 includes two opposite downward extending flanges 14, 16 that function as legs. Formed on the two legs 14, 16 are two laterally extending horizontal flanges 15, 17, respectively, that function as feet. Two pairs of holes 18, 20 are formed in the opposite ends of the feet 15, 17, respectively, that enable them to be selectively attached to a workbench if desired.

Mounted on opposite ends of the platform 12 are two upward extending brackets 22, 26. The brackets 22, 26 are longitudinally aligned over the platform 12 and designed to hold the inside ends of a take-up spool 30 and an unwinding spool 40, respectively. When attached to the brackets 22, 26, the take-up spool 30 and unwinding spool 40 are horizontally aligned and parallel. In the preferred embodiment, the two brackets 22, 26 are L-shape with lower horizontal lower flanges 23, 27 that attach to the platform 12 with two pairs of bolts 21A and nuts 21B.

Figure 5:
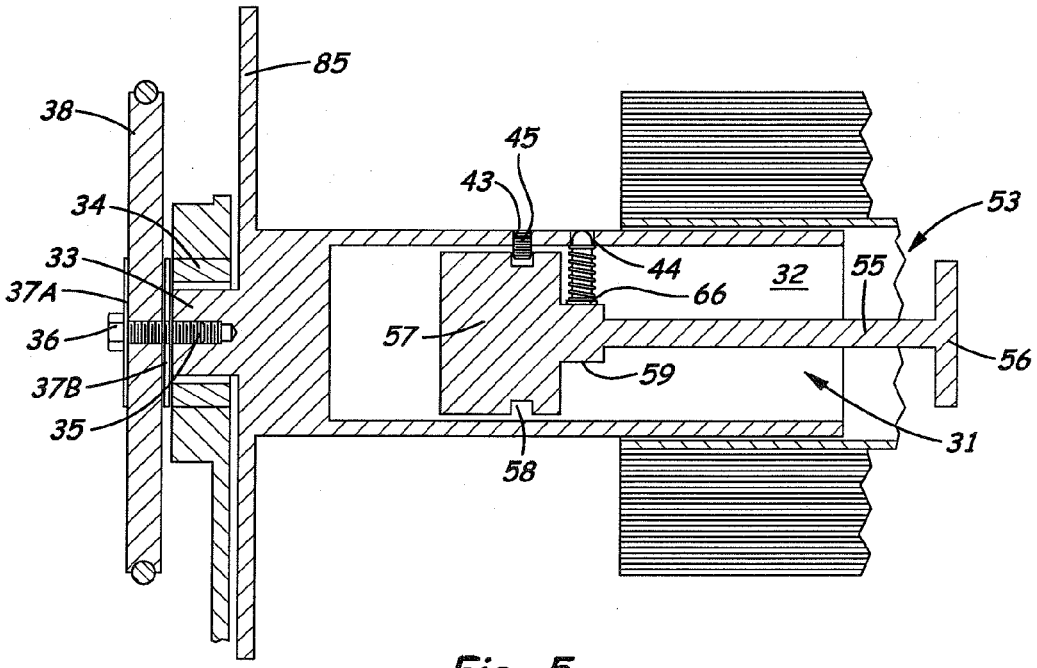
FIG. 5 is a right side sectional view of the take-up spool the cam being rotated so that the plunger is retracted inside the take-up spool.
Figure 6:
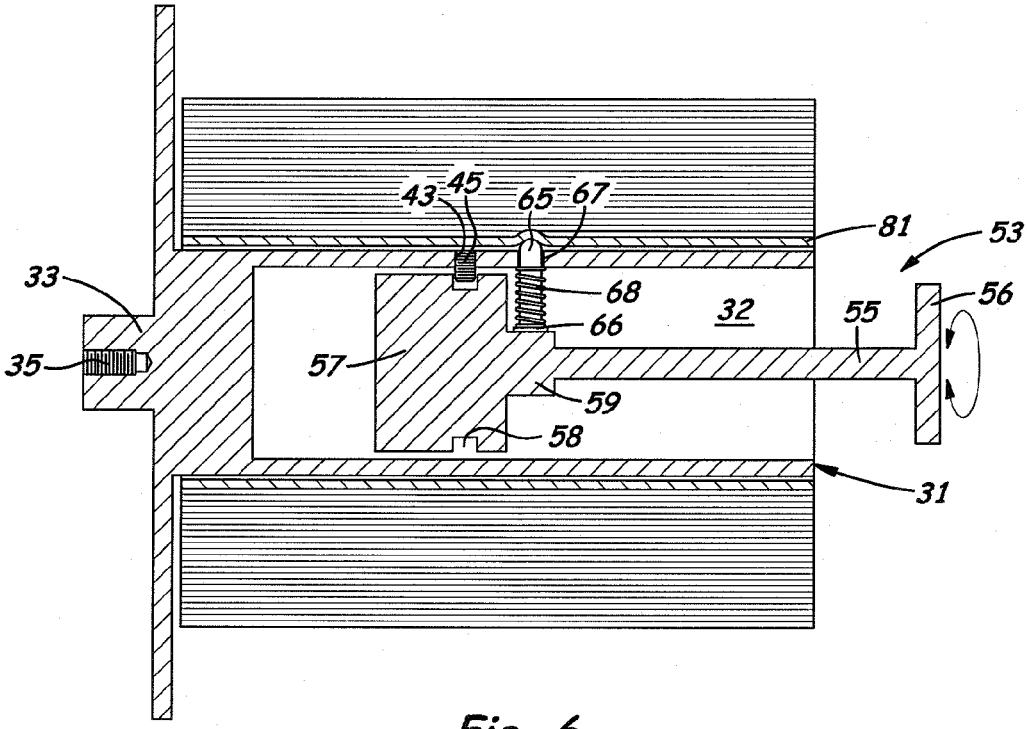
FIG. 6 is a right side elevational view similar to the view shown in FIG. 5 with the cam being rotated so that the plunger extends from the take-up spool and used to hold a roll of toilet paper thereon.

Both the take-up spool 30 and the unwinding spool 40 include a cylindrical spool body 31, 41 with a front opening and a cylindrical inside cavity 32, 42 formed therein, respectively. As shown in FIG. 5 and 6, formed on the proximal end of the spool body 31 is a cylindrical narrow neck 33. During assembly, the neck 33 extends through a bearing 34 mounted on the upper end of the bracket 22. Formed on the proximal end of the neck 33 is a threaded bore 35 through which a threaded bolt 36 is attached. Two large washers 37A, 37B are placed around the bolt 36 to bold the spool body 31 inside the bearing 34 and to reduce friction between the bracket 22 an the spool body 31

On the take-up spool 30, a large pulley 38 is attached to the portion of the longitudinally aligned neck 33 formed thereon. When assembled, the neck 33 extends the bracket 22. A second washer 39A is placed between the large pulley 38 and the bearing 34. Formed inside the neck 33 is a threaded bore 36A. A bolt 36B is attached to the bore 36A and a first washer 37A is placed over the bolt 36B to securely attach the pulley 38 to the take-up spool 30.

Formed through the side walls 41 of both spool bodies 31 and near the spool bodies' central axis is a set screw threaded bore 43 and a plunger bore 44. During assembly, a threaded set screw 45 is attached to the threaded bore 43 and used to hold the handle assembly 53, discussed further below, inside the cavity 32. Also, a cylindrical plunger 65 with a lower wide flange surface 66 is placed inside the plunger bore 44. A spring 68 is disposed around the plunger 65 which bias the plunger 65 inward. The flange surface 66 is sufficiently wide to prevent the plunger 65 from sliding outward through the plunger bore 67.

Located inside cylindrical cavity 32 is a handle assembly 53 used to control the movement of the plunger 65 from the spool body 31. During use, the plunger 65 may be retracted inside the spool body 31 thereby enabling a roll of toilet paper 82, 84 to slide freely over the spool body 31 or extended from the spool body 31 to press against the core 81 on a roll of toilet paper 82, 84 to hold the roll 82, 84 onto the spool body 31. In the first embodiment shown more clearly in FIG. 5, the handle assembly 53 includes a post 55 longitudinally aligned inside the cavity 32. Attached to the distal end of the post 55 is a turn handle 56. Attached to the proximal end of the post 55 is a cylindrical body 57. The body 57 includes a recessed, circular keyway 58 formed at approximately its' upper one-third section. Formed adjacent to the body 57 is a cam surface 59 coaxially aligned with the body 57 and the post 55. The cam surface 59 is oval-shaped. The keyway 58 and cam surface 59 are located on the body 57 so that when the handle assembly 53 is inserted into the cavity 32, they may be aligned with the set screw threaded bore 43 and the plunger bore 44, respectively. The extending and retracting movement of the plunger 65 is coupled to a rotation of the cam 59 so that when the turn handle 56 is rotated approximately 90 degrees clockwise and counter-clockwise direction, the plunger 65 is extended and retracted, respectively, into spool body 31. During assembly, the set screw 45 is rotated so that it extends a sufficient distance into the cavity 32 and into the keyway 58 formed on the cylindrical body 57 to hold the handle assembly 53 inside the cavity 32.

Figure 8:
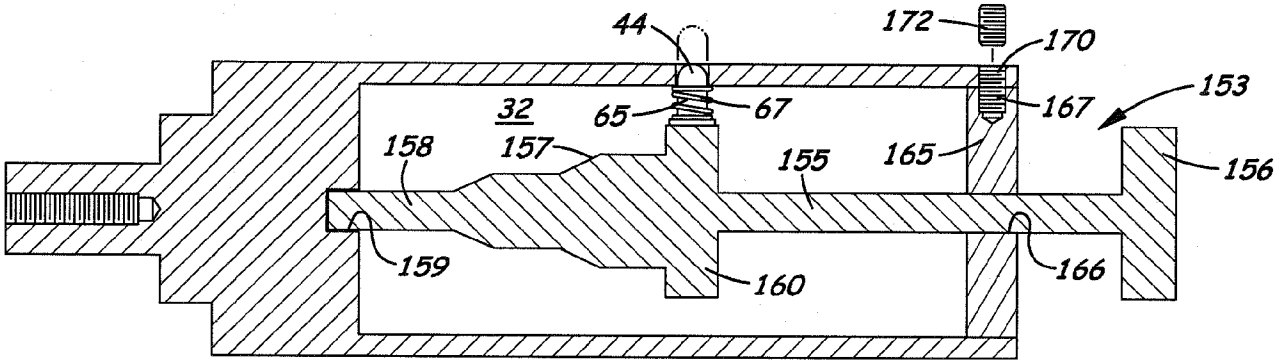
FIG. 8 is a right side elevational view of the second embodiment of the take-up spool with an alternative handle assembly mounted thereon.

Shown in FIG. 8, is a second embodiment of the spool body 31 with a modified rotating handle assembly 153. The handle assembly 153 includes a post 155 longitudinally aligned inside the cavity 32. Attached to the distal end of the post 155 is a turn handle 156. Attached to the proximal end of the post 155 is a modified cylindrical body 157. The cylindrical body 157 includes a inward extending cylindrical neck 158 that is inserted into a neck receiving bore 159 formed on the inside surface of the spool 30. Formed on the end of the cylindrical body 157 is a circular collar 160 upon which a plunger 65 is placed. The plunger 65 extends through a bore 44. Attached over the post 155 is a large support bushing 165. The bushing 165 includes a center bore 166 through which the post 155 extends. Formed on the edge of the bushing 165 is a threaded bore 167 which is aligned and registered with a threaded bore 170 formed on the spool body 31. A set screw 172 is inserted into the two bores 167, 170 to hold the bushing 165 in a fixed position inside on the spool body 31.

Figure 9:
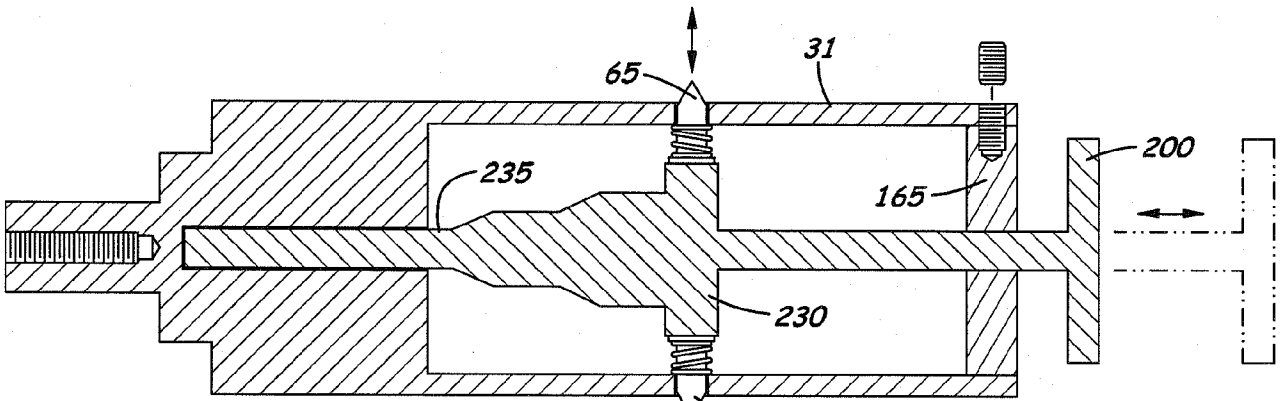
FIG. 9 is a right side, sectional view of a take-up spool that uses a push-pull handle to extend or retract two plunger pins from the opposite sides of the take-up spool.

FIG. 9 shows a sectional side elevational view of a take-up spool 31 that uses a push-pull handle 200 to extend and retract two spring mounted plungers 65. The two plungers 65 ride over a wide cylindrical body 230 formed on the handle 200 when the handle 200 is moved longitudinally inside the spool 31. Integrally formed on the body 230 is a narrow neck 235 that enables the plungers 65 to retract into the spool body when the handle 200 is pulled outward. The distal end of the neck 235 fits into a longitudinally aligned bore formed on the inside of the spool body. The distal end of the neck 235 slides freely into the bore to centrally aligned the distal end of the handle 200 inside the spool 31. The proximal end of the handle 200 is held in place with a large support bushing 165 similar to the bushing 165 shown in FIG. 8.

Attached or formed on the take-up spool 30 is a coaxially aligned, large circular flange 85 designed to keep the toilet paper 82 properly aligned on the roll 82 when the roll 82 attached to the take-up spool 30 and rotated. The unwinding spool 40 may include the large circular flange 85, or it may include a smaller flange 86 as shown. It should be understood that a flange 85 or 86 is not a required structure and be eliminated altogether.

Figure 7:
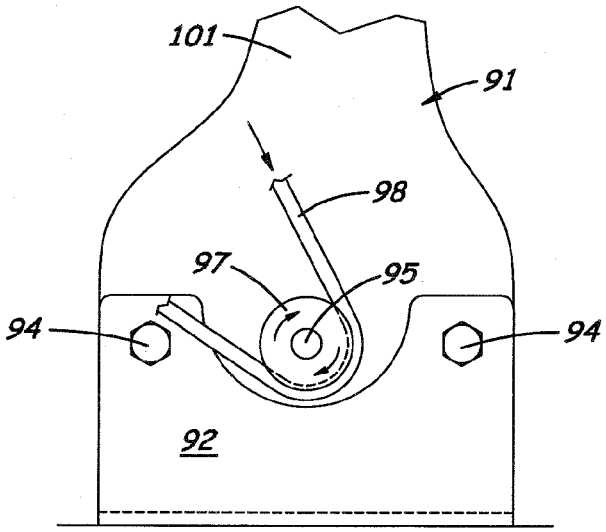
FIG. 7 is a front elevational view of the motor bracket with the electric motor attached thereto.

Formed behind the two spool body brackets 22, 26 is a vertically extending motor bracket 91 designed to hold the electric motor 90 in a fixed horizontal position on the platform 12. In the preferred embodiment, the motor bracket 91 is an L-shaped structure with an upward extending front flange 92 and a horizontal rearward extending lower flange 93. Two sets of threaded bolts 94A and nuts 94B hold the lower flange 93 to the platform 12. As shown in FIG. 7, formed on the front flange 92 is a u-shaped cutout 96 through which the motor's drive shaft 95 extends. Attached to the drive shaft 95 is a drive pulley 97. A belt 98 extends around the drive pulley 97 and over the large pulley 38 attached to the take-up spool 30. Two bolts 94 extend though the motor bracket 91 and connect to the front face of the motor's housing to securely attach the electric motor 90 to the motor bracket 91.

The upper portion 101 of the motor bracket 91 extends above the electric motor 90. Attached to the upper portion 101 is an electrical plug 102. Wires 103, 104 from the electric plug 102 extend downward and connect to the electrical contacts on the electric motor 90. Also attached to the electric plug 102 is single, combination foot pedal and 115 volt A.C. connector 105. Two sets of wires 106, 107 extend from the connector 105 and connect to a foot pedal 110 and to the 115 volt A.C. standard plug 112.

During use, the plungers 65 are retracted on the take-up spool 30 and unwinding spool 40. The first partial toilet paper roll 82 is placed on the take-up spool 30 and a second partial roll of toilet paper 84 is placed on the unwinding spool 40. The loose ends of the toilet paper 82, 84 are over lapped and wound on the take-up spool 30. Tape or some other adhesive may also be used to attach the ends of the paper together. The plungers 65 on the take-up spool 30 and unwinding spool 40 are then extended outward to engage the cylindrical cores on the two rolls of the toilet paper. The electric motor 90 is then plugged in and the foot pedal 110 is then pressed to wind the toilet paper 82 from the second partial roll 84 onto the take-up spool 30. When the first partial roll 82 is sufficient in size or when the second roll 84 is empty, the foot pedal 110 is released to deactivate the electric motor 90. The first toilet paper roll 82 and empty core are removed from the take-up spool 30 and unwinding spool 40, respectively.

Figure 10:
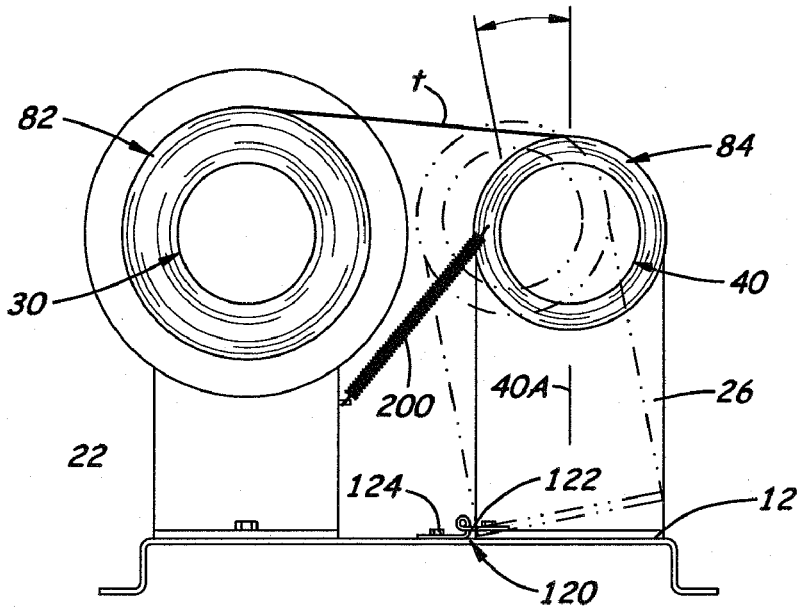
FIG. 10 is a front elevational view of the rewinding machine with the bracket on a unwinding spool pivotally mounted on the inside edge which enables the unwinding spool to rotate inward and outward during operation.
Figure 11:
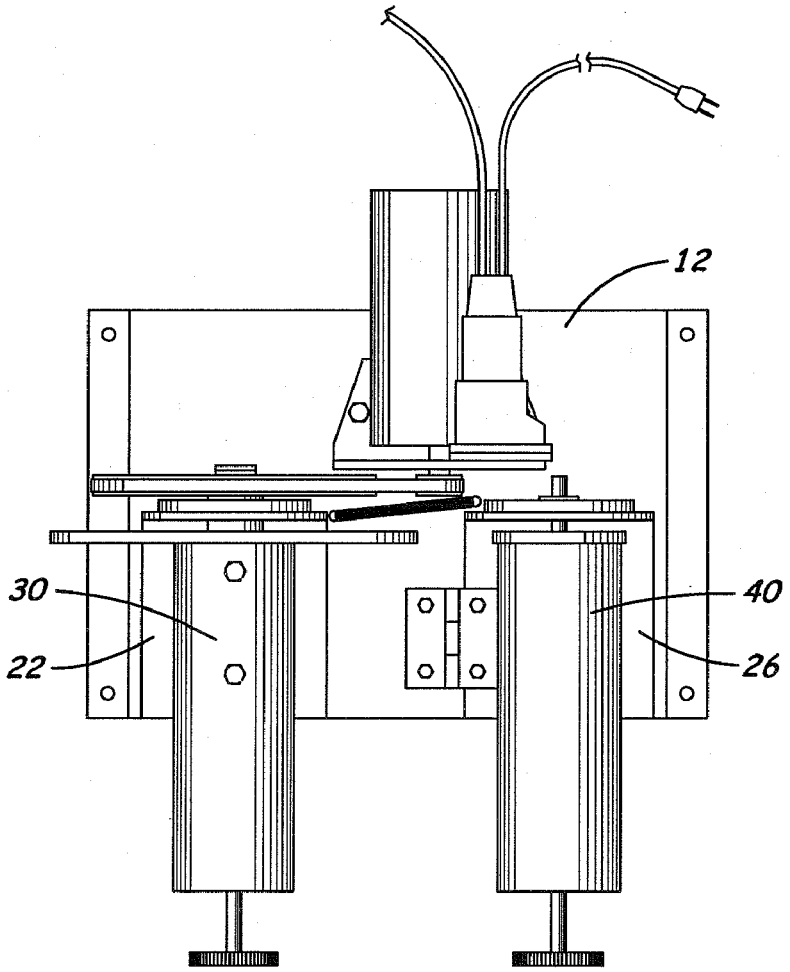
FIG. 11 is a top plan view of the rewinding machine shown in FIG. 10.

FIGS. 10 and 11 show an alternative embodiment of the rewinding machine, in which the bracket 26 used to hold the unwinding spool 40 is pivotally mounted along its inside edge to the platform 12 with a hinge 120. During use, the hinge 120 enables the bracket 12 to rotate inward so that the distance between the unwinding spool 40 and the take-up spool 30 is automatically adjusted. Because the hinge 120 is offset from the center axis 40A of the unwinding spool 40, the unwinding spool 40 rotates outward when at rest. The hinge 120 includes two leaves 122, 224 connected to the bracket 26 and to the platform 12, respectively.

Disposed between the take-up spool 30 and the unwinding spool 40 is an optional spring 200. As mentioned above, the weight of the unwinding spool 40 forces the spool 40 outward so that the tension on the toilet paper placed on the spool is increased. When the spring 200 is used, the tension exerted on the toilet paper is reduced. A sufficient amount of tension continues to be exerted, however, so that the toilet paper is taunt and can be wound in a tight roll. Also, the hinge 120 enables the angle of the section of the toilet paper that is unwound from the unwinding spool 40 (denoted 't' in FIG. 10) to be reduced so that the downward force exerted on the section of the toilet paper 't' is reduced thereby eliminating tearing or separation.

Using the above machine, a method of rewinding partial rolls of toilet paper is disclosed using the following steps:

A toilet paper roll rewinding machine, comprising:

a. selecting a toilet paper rewinding machine with a take-up spool and a hinged unwinding spool, said take-up spool being coupled to an electric motor, said machine include means for selectively attaching a first partial roll of toilet paper onto said take-up spool and second means for selectively attaching a second partial roll of toilet paper on said unwind spool;

b. placing a first and second partial rolls of toilet paper on said take-up spool and said unwind spools;

c. selectively attaching said rolls onto said take-up spool and said unwind spool;

d. wrapping the loose edge of said second roll of toilet paper onto said first roll of toilet paper;

e. activating said electric motor to rewind toilet paper from said second roll onto said first roll until a full roll of toilet paper is produced or until said toilet paper on said second roll has been rewound onto said first roll; and, f. removing said first roll of toilet paper from said take-up spool.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A toilet paper roll rewinding machine, comprising:

a. a platform;

b. a take-up spool with a longitudinal axis, said take-up spool being mounted in a horizontal, elevated position on said platform, said take-up spool capable of being inserted into the cylindrical core used on a roll of toilet paper, said take-up spool being aligned substantially parallel to said unwinding spool, said unwinding spool capable of rotating inward;

c. an unwinding spool pivotally mounted in a horizontal, elevated position on said platform, said unwinding spool including a longitudinal axis and capable of being inserted into the cylindrical core used on a roll of toilet paper;

d. means for selectively holding a partial roll of toilet paper on said take-up spool;

e. means for selectively holding a partial roll of toilet paper on said unwinding spool;

f. a spring attached to said unwinding spool to resiliently force said unwinding spool and said take-up spool together;

g. an electrical motor coupled to said take-up spool enabling said take-up spool to rotate; and, h. a switch connected to said electric motor used to selectively activate and deactivate said electric motor.

2. The toilet paper rewinding machine, as recited in claim 1, wherein said platform includes means for connection to a workbench.

3. A toilet paper roll rewinding machine, comprising:

a. a platform;

b. a take-up spool with a longitudinal axis, said take-up spool being mounted in a horizontal, elevated position on said platform, said take-up spool capable of being inserted into the cylindrical core used on a roll of toilet paper, said take-up spool being aligned substantially parallel to said unwinding spool, said unwinding spool capable of rotating inward;

c. an unwinding spool pivotally mounted in a horizontal, elevated position on said platform, said unwinding spool including a longitudinal axis and capable of being inserted into the cylindrical core used on a roll of toilet paper;

d. means for selectively holding a partial roll of toilet paper on said take-up spool that includes at least one extending and retracting plunger coupled to the longitudinal movement of the handle longitudinally aligned inside said take-up spool;

e. means for selectively holding a partial roll of toilet paper on said unwinding spool;

f. an electrical motor coupled to said take-up spool enabling said take-up spool to rotate; and, h. a switch connected to said electric motor used to selectively activate and deactivate said electric motor.

4. The toilet paper rewinding machine, as recited in claim 1, further including a foot pedal switch connected to said electric motor.

5. A toilet paper roll rewinding machine, comprising:

a. a lower platform;

b. an unwinding spool pivotally mounted on said lower platform, said unwinding spool including a longitudinal axis and capable of being inserted into the cylindrical core used on a roll of toilet paper;

c. a take-up spool with a longitudinal axis, said take-up spool being mounted on said lower platform so that said longitudinal axis on said unwinding spool and said take-up spool are parallel, said take-up spool capable of being inserted into the cylindrical core used on a roll of toilet paper;

d. means for selectively holding a roll of toilet paper on said take-up spool;

e. a means for biasing said unwinding spool and said take-up spool together;

f. an electrical motor coupled to said take-up spool enabling said take-up spool to rotate; and, g. a switch connected to said electric motor used to selectively activate and deactivate said electric motor.

6. The toilet paper rewinding machine, as recited in claim 5, wherein said means for biasing is a spring attached to said unwinding spool to resiliently force said unwinding spool and said take-up spool together.

7. The toilet paper rewinding machine, as recited in claim 5, wherein said means for holding a roll of toilet paper on said take-up spool is at least one extending and retracting plunger coupled to the longitudinal movement of the handle longitudinally aligned inside said take-up spool.

8. A method for rewinding partial rolls of toilet paper, comprising the following steps:

a. selecting a toilet paper rewinding machine with a take-up spool and a pivotally mounted unwinding spool, said take-up spool being coupled to an electric motor, said take-up spool and said unwinding spool being biased together, said machine include means for selectively attaching a first partial roll of toilet paper onto said take-up spool and second means for selectively attaching a second partial roll of toilet paper on said unwinding spool;

b. placing a first and second partial rolls of toilet paper on said take-up spool and said unwinding spools, respectively;

c. wrapping the loose edge of said second roll of toilet paper onto said first roll of toilet paper so that the toilet paper on said unwinding spool may be pulled onto said first roll of toilet paper on said take-up spool;

d. activating said electric motor to rewind toilet paper from said second roll onto said first roll until a full roll of toilet paper is produced or until said toilet paper on said second roll has been rewound onto said first roll; and, e. removing said first roll of toilet paper from said take-up spool.

* * * * *